United States Patent [19]

Pfeiffer et al.

[11] Patent Number: 4,880,138

[45] Date of Patent: Nov. 14, 1989

[54] COVER ASSEMBLY FOR A DRUM COMPOSED OF SYNTHETIC RESIN

[75] Inventors: Pierre Pfeiffer, Drulingen; Benoit Cheval, Saverne; Paul Sigwalt, Drulingen, all of France

[73] Assignee: Sotralentz S. A., Drulingen, France

[21] Appl. No.: 267,414

[22] Filed: Nov. 4, 1988

[30] Foreign Application Priority Data

Nov. 7, 1987 [DE] Fed. Rep. of Germany ..... 3737884

[51] Int. Cl.[4] ..... B65D 45/32; B65D 1/48

[52] U.S. Cl. ..... 220/320; 220/73

[58] Field of Search ..... 220/319, 320, 321, 73

[56] References Cited

U.S. PATENT DOCUMENTS

| | | | |
|---|---|---|---|
| 2,655,397 | 10/1953 | Augspurger | 220/321 |
| 3,343,711 | 9/1967 | Gotshalk | 220/73 |
| 4,022,345 | 5/1977 | Butz | 220/73 |
| 4,177,934 | 11/1979 | Hammes | 220/320 |
| 4,219,125 | 8/1980 | Wiltshire | 220/320 |
| 4,500,010 | 2/1985 | Schutz | 220/320 |
| 4,768,673 | 9/1988 | Prztulla | 220/73 |

FOREIGN PATENT DOCUMENTS

| | | | |
|---|---|---|---|
| 510059 | 12/1952 | Italy | 220/320 |

*Primary Examiner*—George E. Lowrance

*Attorney, Agent, or Firm*—Herbert Dubno

[57] ABSTRACT

A blow-molded drum body has a cover fitted over this neck and provided with an outer wall with a shoulder clamped against a connecting ring affixed to the body during the blow-molding thereof. The T-section ring has an upper flange overlapped by the cover and a lower flange which is thicker than its upper body so that a clamping ring fitting over the shoulder and the web of the connecting ring can bear upon the overlapping region of the outer wall of the cover and hence indirectly upon the upper flange, but directly upon the lower flange.

13 Claims, 3 Drawing Sheets

COVER ASSEMBLY FOR A DRUM COMPOSED OF SYNTHETIC RESIN

FIELD OF THE INVENTION

Our present invention relates to drums or barrels composed of synthetic resin, and more particularly, to a cover assembly for such a drum or barrel of the type which utilizes a tensionable clamping member to hold the cover in place.

BACKGROUND OF THE INVENTION

Blow-molded drum bodies can be provided with a neck portion at one end of the barrel defining a mouth adapted to receive a cover which, like the drum body, is formed from synthetic resin and particularly a thermoplastic material.

The cover can have a portion nesting within the mouth formed with a trough outwardly of the cover bottom into which the neck of the barrel is snugly fitted. A flange or shoulder formed on the cover projects outwardly and is engaged by a tensionable clamping member which anchors this shoulder to a ring which can be applied to the drum body through the blow molding thereof and which has a T-shaped cross section. The outwardly-extending web of this T-section ring forms a second flange which is drawn toward the shoulder of the cover upon tensioning of the clamping ring.

Such barrels or drums have been widely used for the marketing, distribution and transport of chemical products and must have sufficient strength and effective sealing to resist falls, shocks and the like which may arise during transport and handling and, in addition, must have sufficient strength to enable the barrels or drums to be stacked in a full condition.

In the system of the type described in German patent document No. 36 19 367, the T-section connecting ring is located wholly below the apron of the cover and bracing of the claiming ring and of the connecting ring against one another and the cover cannot occur in an effective manner.

As a consequence, singular stresses are applied to the transition region of the drum at which the connecting ring bears upon the drum body and breakage may occur under the extreme conditions mentioned previously.

The sealing of the drum is neither reliable nor satisfactory.

The clamping ring, moreover, has its flanks or flanges, defining its U-section, of different widths so that manipulation of the clamping ring is not only inconvenient, but also time-consuming, since reorientation of the clamping ring is frequently necessary.

The cover-fixing assembly described in German patent document No. DE-OS 25 44 491 does not use a connecting ring of the aforedescribed type, but rather forms the neck in one uniform structure which fits tightly in the trough of the cover. The counterflange with respect to which the cover is anchored by the clamping ring is here formed during the blow-molding process.

Naturally the need for a relatively massive flange which must be formed by compaction of the blow-molded drum wall poses problems in fabrication and limits the thickness of the counterflange since practical considerations required that this thickness be no more than twice the wall thickness. In any event, weakened regions develop in this system at the transition zone between the neck of the drum and the drum body.

OBJECTS OF THE INVENTION

It is the principal object of the present invention to provide an improved drum in which the drum body is blow-molded from a thermoplastic synthetic resin and the drum cover consists of a thermoplastic synthetic resin whereby drawbacks of prior art systems are obviated.

Another object of the invention is to provide, especially for a drum or barrel of the latter type, an improved cover-attachment assembly which is more reliable under extreme conditions of handling and stress than the earlier system.

SUMMARY OF THE INVENTION

These objects and others which will become apparent hereinafter are attained, in accordance with the present invention in a drum which comprises:

a drum body of thermoplastic synthetic resin material formed at an end of the body integrally with a neck set inwardly of the body and defining a mouth of the barrel, and a transition section between the neck and the body;

a generally T-section connecting ring secured to the transition section below the mouth, the connecting ring having a pair of flanges forming a crossbar of the T of the T-section abutting the neck and a web projecting outwardly from the crossbar;

a cover formed with an annular trough defined between inner and outer walls flanking the neck and tightly fitted over the neck and into the mouth, the cover being integrally provided with a cover bottom spanning the end of the body and recessed therein below the mouth, the outer wall being formed at a free end thereof with an outwardly extending shoulder generally parallel to and juxtaposed with the web, the outer wall in a region of the shoulder overlying one of the flanges extending toward the mouth; and a tensionable clamping ring of substantially U-section engaging over the web and the shoulder and clamping same upon tensioning of the clamping ring, the U-section being defined by a pair of flanks of the clamping ring, one of the flanks engaging the shoulder in the region and bearing inwardly upon the free end where the free end overlies the one of the flanges upon tensioning of the clamping ring, the other flank of the pair of flanks bearing inwardly upon the other of the flanges upon tensioning of the clamping ring.

More specifically, the upper flange or annular segment of the cutting ring is, in accordance with our invention, overlain by the outer wall of the cover all around the apron formed by this outer wall and the apron flank of the U-section clamping ring can bear against the overlapping portion of the outer wall and press this overlapping portion against the overlapped flange.

Furthermore, the lower flange of the U, i.e. the lower flank of the clamping ring can bear directly against the thicker lower flange or annular segment of the connecting ring so as to brace the clamping ring thereagainst.

In the connecting assembly of the present invention, therefore, both the upper flange and the lower flange of the T-section connecting ring, once the cover has been set in place, are braced against and by the clamping ring.

Should, therefore, shocks arise in handling, e.g. in the stacking of drums in a full state or by the dropping of a drum or even in the transport of a drum, the impact stress will be distributed to the cover and via the cover to the connecting ring or to the thick flange of the connecting ring by the clamping ring so that singular stresses on the flanges, on the neck or body of the drum where the flanges bear thereon and/or where the clamping ring bears upon the cover and the connecting ring are avoided.

The danger of breakage is reduced or eliminated and both reliability and safety are enhanced.

It has been found to be advantageous, moreover, to provide the clamping ring so that, upon tightening of the clamping force generating unit of the clamping ring, either a toggle lever or a bolt arrangement, for example, the flanks of the U-section clamping ring bear directly against the overlapping region of the cover and the thicker flange of the connecting ring so that all of the elements in this region and engaged by the clamping ring are provided with a prestress which is maintained even in the absence of stress from the other means.

The connecting arrangement is less likely to spring open and is therefore more reliable.

The lower flange of the connecting ring can, in accordance with the invention, be made thicker than the upper flange by approximately the thickness of the outer wall or apron of the cover. This ensures that the lower flange will project outwardly by approximately this wall thickness so that the two flanks of the U-section clamping ring can have the same flank width.

This arrangement has been found to have two advantages. On the one hand it reinforces the connecting ring in the region in which the clamping bears thereon and the clamping ring is subjected to the greatest stress. On the other hand, it facilitates the handling of the drum body and the clamping ring in the fabrication of the drum body since the clamping ring does not require any special orientation in assembling the cover to the drum body.

Advantageously, both the shoulder at the lower edge of the outer wall and the cover and the web of the T-section connecting flange can taper outwardly so that the U-section clamping ring can have outwardly converging flanks which conform to the inclinations of the tapering flanks of the shoulder and web respectively.

The lower flange and/or the web or counterflange and/or the shoulder may be provided with material-conserving chambers.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
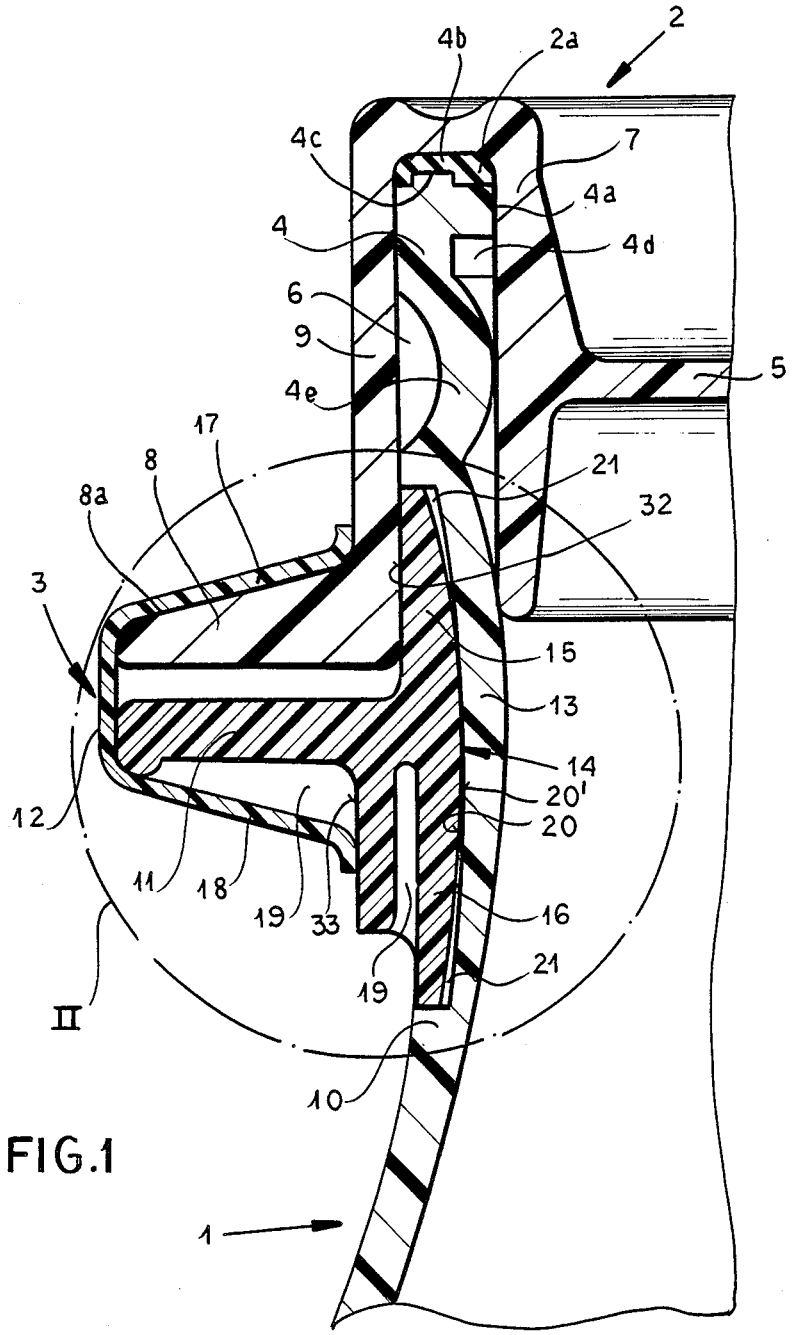
FIG. 1 is a fragmentary axial section of a drum with a cover according to the invention.

In the drawing, we have shown a blow-molded drum body and a cover 2 which, like the drum body, is composed of a thermoplastic synthetic resin. A clamping ring connection 3 secures the cover 2 to the drum body 1.

The drum body 1 is blow-molded from thermoplastic synthetic resin and has a neck 4 defining a mouth **4*a* of the drum and of a diameter less than that of the drum body. The neck 4 is also provided with a seal 4*b* around its upper edge and held in place by a dovetail arrangement 4*c*. Below this seal, a channel 4*d* is provided and the wall of the neck can be bowed at 4*e* as is clearly visible in FIG. 1. The bowed portion 4*e* allows the neck to be resiliently held in a trough 6 formed along the outer perimeter of the cover 2**.

The cover 2 is provided with a recessed cover bottom 5 inwardly of the trough 6 in which the neck is to be nested. In the embodiment, illustrated, moreover, the cover bottom 5, when the cover is in place, is located within the neck 4 and preferably in the region of the bulge **4*e* so that the bulge is braced against the inner wall 7 of the cover substantially midway of the height thereof directly opposite the cover bottom 5**. This has been found to give especially effective stability in the region of the neck of the drum.

The cover 2 has the end **2*a* of its trough 6 pressed against the seal 4*b***.

The outer wall 9 of the trough 6 and the cover 8 is provided with an outwardly extending shoulder 8 which tapers in thickness outwardly so as to have a surface **8*a* conforming in inclination to the inclination of a flank 17 of a U-section clamping ring 12 forming part of the assembly 3. The shoulder 8 is provided in a region of the outer wall 9 overlapping the upper flange 15 of a T-section connecting ring 14 which is received in a recess 20 of a transition region 13** between the neck and the body of the drum.

The connecting ring 14 is provided with a web 11 which forms a counterflange juxtaposed with the shoulder 8 and having a surface **11*a* inclined with the inclination of the flank 18**.

The transition region 13 is located along the inwardly extending portion 10 of the drum body.

The portion of the T-section connecting ring engaged by the drum body is, as shown, the bar of the T. This portion comprises an upper annular flange 15 and a lower annular flange 16.

The connecting ring 14 is either bonded to the drum body, i.e. is connected thereto by a material-to-material connection, or is form-fittingly engaged thereby during the blow-molding of the drum body and the formation of the transition region 13.

From FIG. 1 it can be seen that the upper flange 15 of the connecting ring is overlapped by the region of the outer wall 9 of the cover 2 provided with the shoulder 8 and encompassed by the flank 17, 18 of the U-section clamping ring 12.

When the clamping ring is tightened or tensioned to seal the drum, this upper U-flange of the clamping ring 12 bears upon this region of the cover and presses this region tightly against the overlapped flange 15 of the connecting ring. At the same time the lower U-flank 18 of the clamping ring 12 bears directly upon the lower annular flange 16 of the connecting ring 14. Thus in accordance with the instant invention, the clamping ring 12 is braced via its two U-flanks on the upper and lower flanges 15 and 16, the latter directly and the former through the intermediary of the aforementioned region of the outer wall 9.

Figure 2:
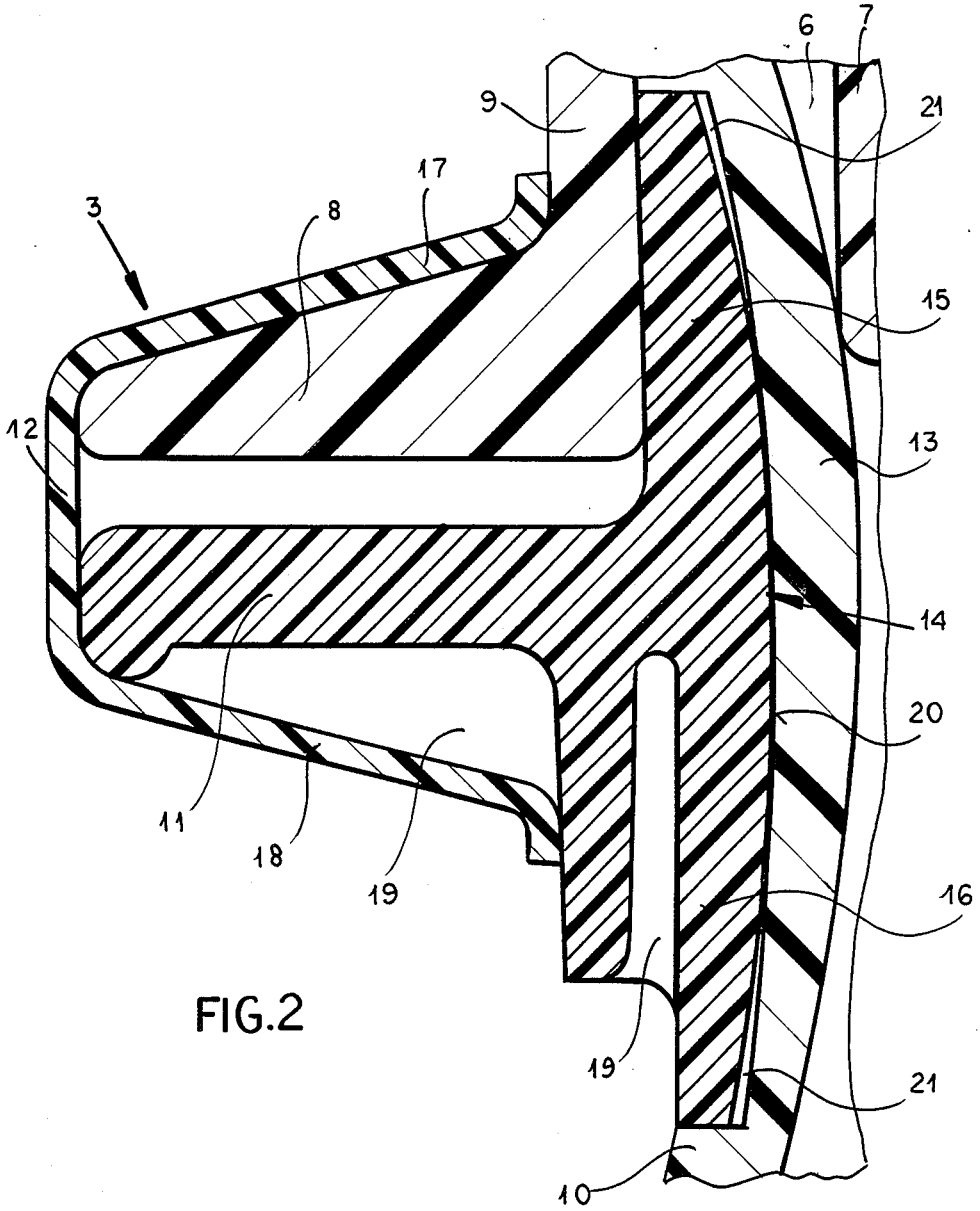
FIG. 2 is a detail view of the region II of FIG. 1 drawn to a larger scale.
Figure 5:
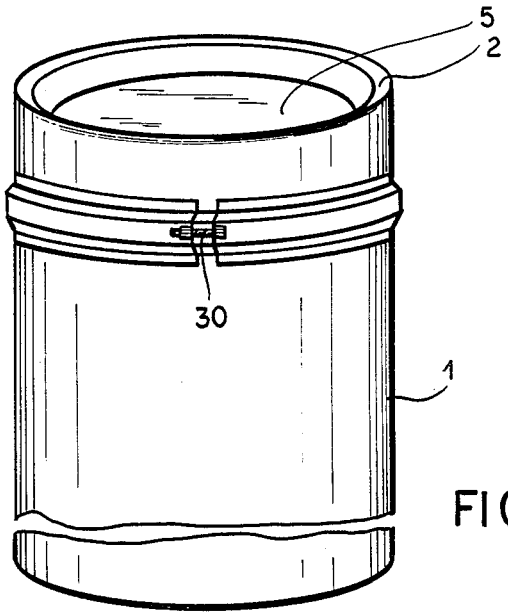
FIG. 5 is an elevational view of the drum showing the clamping ring in place.

A comparison of FIGS. 1 and 2 shows that the connecting ring 14 has its lower flange 16 of a thickness greater than that of the upper flange by approximately the thickness of the outer wall 9 so that this lower flange projects outwardly beyond the upper flange by approximately this thickness.

The clamping ring 12 can then have U-flanks of the same flank width.

Both shoulder 8 and the counter flange 11 have outwardly tapering wedge-shaped cross sections and the U-flank 17 and 18 are complementary in shape thereto so that upon tightening of the clamping ring 12, the wedge action draws the shoulder and counterflange toward one another.

Figure 4:
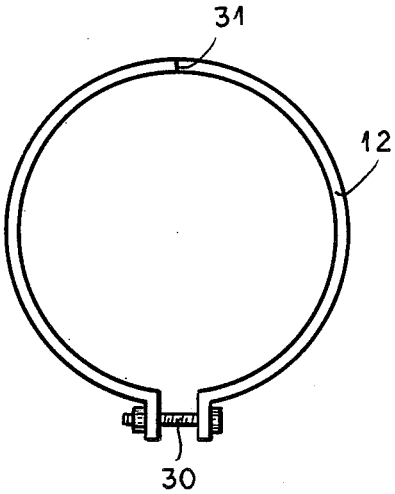
FIG. 4 is a plan view of the clamping ring.
Figure 3:
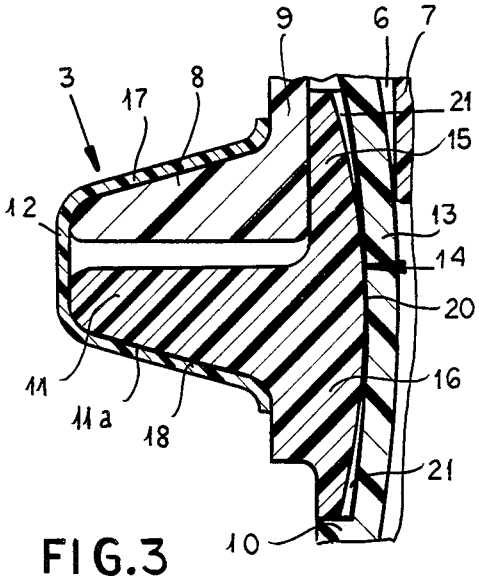
FIG. 3 is a view similar to FIG. 2 but on a smaller scale of the connecting region taken in section which does not extend through the material-saving compartments of FIG. 2.

The clamping can be effected by tightening of the bolt arrangement 30 securing the free needs of the clamping ring 12 together. The clamping ring 12 may be injection-molded in a number of parts and these segments can be form-fittingly interconnected or bonded together at appropriate junctions 31 as shown in FIG. 4, for example.

From FIG. 2 it will be apparent that the lower flange 16 and/or the counterflange 11 and/or the outer shoulder 8 can be provided with recesses 19 spaced around these elements and forming material-saving chambers.

The annular part 15, 16 of the connecting ring 14 turn toward the drum may have a lens-shaped surface 20' and the body 1 of the drum, being molded around this connecting ring, will follow the drum. The surfaces 32 and 33 of these flanges turned away from the drum can be cylindrical.

The lens-shaped surface 20 can be additionally provided with ribs 21 having a height of 0.5 to 2 mm to anchor the connecting ring in the material of the drum body which is blow-molded into the spaces between such ribs.

In the embodiment shown, the neck 4, with the drum upright as illustrated, extends substantially vertically in the region of the connecting region 14. The connecting ring 14 can also be a multi-segment ring having the segments made by injection molding and the junctions between the segments bonded together or form-fittingly interconnected.

We claim:

1. A drum, comprising:

a drum body of thermoplastic synthetic resin material formed at an end of said body integrally with a neck set inwardly of said body and defining a mouth of said barrel, and a transition section between said neck and said body;

a generally T-section connecting ring secured to said transition section below said mouth, said connecting ring having a pair of flanges forming a crossbar of the T of said T-section abutting said neck and a web projecting outwardly from said crossbar;

a cover formed with an annular trough defined between inner and outer walls flanking said neck and tightly fitted over said neck and into said mouth, said cover being integrally provided with a cover bottom spanning said end of said body and recessed therein below said mouth, said outer wall being formed at a free end thereof with an outwardly extending shoulder generally parallel to and juxtaposed with said web, said outer wall in a region of said shoulder overlying one of said flanges extending toward said mouth; and a tensionable clamping ring of substantially U-section engaging over said web and said shoulder and clamping same upon tensioning of said clamping ring, said U-section being defined by a pair of flanks of said clamping ring, one of said flanks engaging said shoulder in said region and bearing inwardly upon said free end where said free end overlies said one of said flanges upon tensioning of said clamping ring, the other flank of said pair of flanks bearing inwardly upon the other of said flanges upon tensioning of said clamping ring.

2. The drum defined in claim 1 wherein said flanks diverge inwardly and are braced against said free end in said region and against said other of said flanges.

3. The drum defined in claim 1 wherein said other flange of the said connecting ring has a thickness greater than the thickness of said one of said flanges by an amount equal substantially to the thickness of said outer wall and projects from said transition suction beyond said one of said flanges outwardly by said amount, said flanks having substantially equal widths.

4. The drum defined in claim 3 wherein said shoulder tapers outwardly and has a surface complementary to that of said one of said flanks.

5. The drum defined in claim 4 wherein said web tapers outwardly and has a shoulder complementary to that of said other of said flanks.

6. The drum defined in claim 1 wherein at least one of said shoulder, said web and said flanges is compartmented to save material.

7. The drum defined in claim 1 wherein said connecting ring in the region of said cross bar has a lens-shaped convex surface complementarily fitting into said transition section of said body of the drum.

8. The drum defined in claim 1 wherein said connecting ring is formed with a cylindrical surface turned away from said drum body.

9. The drum defined in claim 1 wherein said connecting ring is formed at said web with a planar surface confronting said shoulder.

10. The drum defined in claim 1 wherein said connecting ring engages said transition section in a mating junction provided with ribs having a height of substantially 0.5 to 2 mm.

11. The drum defined in claim 1 wherein said neck in an erect position of the drum extends substantially vertically in the region of the connecting ring.

12. The drum defined in claim 1 wherein said clamping ring is composed of a plurality of injection-molded parts.

13. The drum defined in claim 1 wherein said connecting ring is secured to said transition section by blow-molding said drum body into engagement with said connecting ring.

* * * * *